United States Patent [19]

Wahlström et al.

[11] 4,403,424

[45] Sep. 13, 1983

[54] A DRIER CABINET FOR DRYING FIRE HOSES OR OTHER SIMILAR HOSES

[75] Inventors: Hans V. Wahlström, Bergåsstigen 3, 182 33 Danderyd; Rolf E. Nilsson, Uttervägen 9, 195 00 Märsta; Kjell A. Pihlgren, Uppland Väsby, all of Sweden

[73] Assignees: Hans V. Wahlström, Danderyd; Rolf E. Nilsson, Märsta, both of Sweden

[21] Appl. No.: 248,706

[22] Filed: Mar. 30, 1981

[51] Int. Cl.[3] ..... F26B 9/06

[52] U.S. Cl. ..... 34/104; 34/107; 34/209; 34/210; 34/215

[58] Field of Search ..... 34/209, 210, 212, 213, 34/214, 215, 104, 107, 202, 38; 229/44 R, 15

[56] References Cited

U.S. PATENT DOCUMENTS

| | | | |
|---|---|---|---|
| 756,717 | 4/1904 | Schools | 34/104 |
| 1,108,565 | 8/1914 | Feuillette | 34/104 |
| 1,539,976 | 6/1925 | Vernaci et al. | 34/214 |
| 1,564,917 | 12/1925 | White | 34/107 |
| 2,826,824 | 3/1958 | Campbell | 34/214 |
| 3,176,898 | 4/1965 | Seger, Jr. | 229/44 R |
| 4,206,554 | 6/1980 | Fowler | 34/210 |
| 4,227,315 | 10/1980 | Hight | 34/86 |

FOREIGN PATENT DOCUMENTS 526756 of 0000 Switzerland .

*Primary Examiner*—Larry I. Schwartz

*Attorney, Agent, or Firm*—Fleit, Jacobson & Cohn

[57] ABSTRACT

A drier cabinet for drying fire-hoses of other similar hoses comprises an elongated horizontal receptacle (10), in which a plurality of hoses (19) may be placed side by side in extended positions to undergo drying in said receptacle. In order to permit a continuous operation of the drier cabinet, the receptacle (10) is divided into two parallel drying chambers (11), extending in side by side relationship along the length of the receptacle. At their upper ends, the drying chambers (11) have longitudinally extending openings which are individually closable by means of appurtenant covers (13). The two covers (13) are rigidly mounted on a common rotatable shaft (14), located between them and connected to a single driving motor (16). Additionally, the two covers (13) act as counterweights for each other to reduce the required driving power.

8 Claims, 1 Drawing Figure

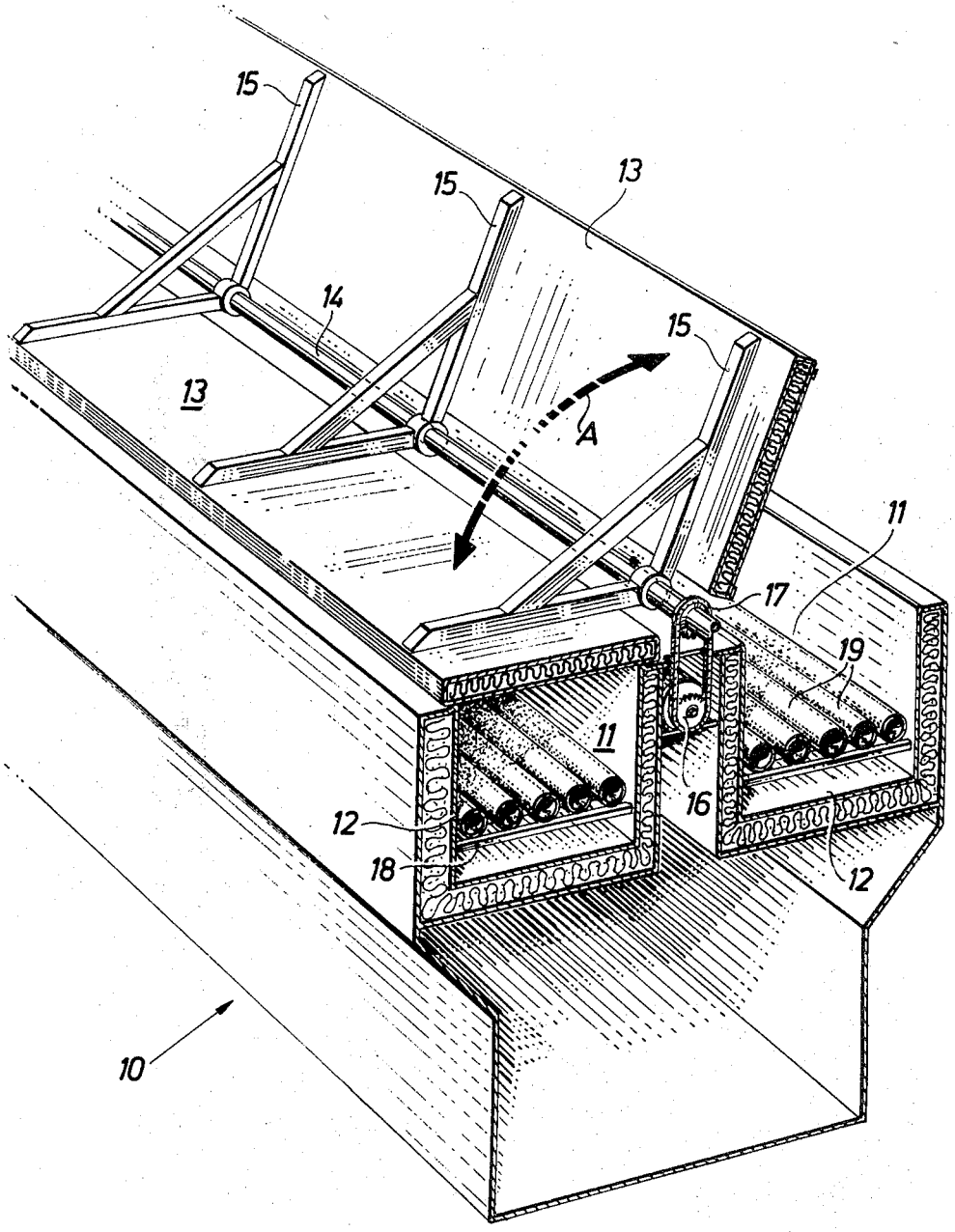
15
15
13
14
15
13
A
11
17
19
11
16
12
18
12
10

A DRIER CABINET FOR DRYING FIRE HOSES OR OTHER SIMILAR HOSES

The present invention relates to a drier for drying fire-hoses or other similar hoses. More particularly, the invention relates to such a drier cabinet, comprising an elongated horizontal receptacle in which a plurality of wet hoses may be placed side by side in extended positions to undergo drying in said receptacle upon closure of the space in which the hoses have been placed.

In practice, a drier cabinet of said kind usually forms part of a complete hose cleaning plant, also including a washing equipment, located at one end of said receptacle. Hoses to be cleaned are drawn slowly one by one through said washing equipment and are then laid down in the receptacle of the drier cabinet through a longitudinal opening, provided at the upper end of said receptacle. When a drying process is to be initiated, said opening is closed by means of a suitable cover. The washing operation successively performed on the hoses as well as the step of laying down the hoses in the receptacle takes considerable time. Additional time is spent on testing the hoses, before the drying process can be started. In prior art driers of the above kind, said time consumption has resulted in a considerable restriction of the time during which the drier may be used for performing drying operations. Since, in addition hereto, another set of hoses cannot be washed as long as a drying operation is effected on a set of hoses previously washed, the capacity of the complete hose cleaning plant has been low.

An object of the invention is to provide an improved drier cabinet of the kind initially specified, which facilitates an almost continuous operation of the drier itself as well as of a complete hose cleaning plant wherein the drier is included.

According to the invention, for this purpose, there is provided a drier cabinet of said kind, which is primarily characterized in that the receptacle is divided into two parallel drying chambers, extending in side by side relationship along the length of the receptacle and having individually closable longitudinal openings at their upper ends.

By dividing the receptacle of the drier cabinet into two parallel drying chambers, as proposed according to the invention, it will be possible, as soon as a drying process in one of said chambers has been completed, to start a drying process in the other drying chamber and, while the latter process takes place, to remove the dried hoses from the firstmentioned drying chamber and then successively to fill it with a new set of washed hoses. The drying operations to be effected in the drying chambers may suitably be obtained by blowing hot air through the hoses as well as around them within said chambers. The necessary equipment for generating hot air and for providing moisture separation, etcetera, may suitably be common to both drying chambers.

Since the drying chambers are intended to operate in an alternating manner, the drier cabinet may be provided with a single cover which is common to both drying chambers and adapted to close only one of said chambers at a time. However, according to a preferred embodiment of the invention, the drier cabinet may be provided with two covers, one for each drying chamber, in which case the two covers may be connected to each other so as to permit only one drying chamber at a time to be closed by its cover. Such an interconnection between the two covers will make it possible to operate them by means of a common driving element and eliminates the need for separate driving elements for the two covers. Moreover, the two covers may be mounted on a common carrier and be arranged to act as counterweights for each other. Such an arrangement will result in a reduction of the required driving power for the driving member of the two covers. Both covers may suitably be rigidly mounted on a common rotatable shaft, located between them. In this case, the covers may extend in such directions from said shaft as to form an angle exceeding 90° between their upper surfaces. Said angle may preferably amount to about 120°. The maximum resultant torque on said shaft, caused by the two covers, will then amount to a value corresponding to half the value of the maximum torque on the shaft, caused by one of said covers.

Below the invention will be described in further detail, reference being had to the accompanying diagrammatic drawing in which the single FIGURE shows a perspective cross-sectional view of a drier cabinet according to an embodiment of the invention, selected by way of example.

The drier cabinet, shown in the drawing, comprises an elongated box-like body of sheet metal, generally designated 10. At its upper end, the drier cabinet is provided with two parallel drying chambers 11 which extend in the longitudinal direction of body 10 and are slightly spaced apart in the transversal direction of body 10. Said two drying chambers 11 are formed by elongated tubs 12 having heat-insulated side walls and bottom walls. The longitudinal openings provided at the upper ends of drying chambers 11 are individually closable, each by means of an appurtenant cover 13. These two covers 13 are carried by a common shaft 14, located between the two covers and extending in the longitudinal direction of body 10. The two covers 13 are rigidly mounted on shaft 14 by means of a number of supporting arms 15 evenly distributed along the length of shaft 14. Between their upper surfaces, the two covers 13 form an angle of about 120°. Reference numeral 16 designates a driving motor for shaft 14, mounted on body 10. By means of said motor 16, the two covers 13 may be swung in unison in a manner indicated by double arrow A to permit one drying chamber 11 at a time to be closed by its appurtenant cover 13. The driving motor 16, which suitably may consist of a hydraulic motor, has been shown to be connected to shaft 14 by means of a chain transmission 17.

In each drying chamber 11, a grid-like supporting member 18 is provided some distance above the bottom of the chamber and extending along the whole length of the chamber. On said supporting member 18, a number of hoses 19 may be placed side by side in extended positions to undergo a drying operation upon closure of chamber 11 by means of its appurtenant cover 13. The drying operation may suitably be effected by blowing hot air through hoses 19 as well as around said hoses within drying chamber 11. In order to minimize the required energy for heating the drying air, said air may suitably be caused to circulate within a closed system, comprising necessary means for separating moisture from the air when leaving the drying chamber. Since the two drying chambers 11 are intended to operate in an alternating manner, said system, which may be common to both drying chambers, need not have a larger capacity than required for one of said chambers.

We claim:

1. A drier cabinet for use in a drier for drying fire-hoses or other similar hoses, said drier cabinet comprising:

an elongated horizontal receptacle divided into two parallel drying chambers extending in side by side relationship along the length of the receptacle and having individually closable longitudinal openings at their upper ends, each of said chambers receiving a plurality of wet hoses through said longitudinal opening, the hoses being placed side by side in extended positions to undergo drying in said drying chambers upon closure of the longitudinal openings of the chambers; and means for closing the longitudinal openings of said drying chambers to thereby enclose the hoses within the drying chambers, said means for closing comprising two covers, one for each drying chamber, said two covers being connected to each other so as to permit only one drying chamber at a time to be closed by its cover.

2. A drier cabinet according to claim 1, characterized in that the two covers are mounted on a common carrier and arranged to act as counterweights for each other.

3. A drier cabinet according to claim 1, characterized in that the two covers are rigidly mounted on a common rotatable shaft located between them, the two covers extending in such directions from said shaft as to form an angle exceeding 90° between their upper surfaces.

4. A drier cabinet according to claim 1, characterized in that the upper surfaces of the two covers form an angle of about 120° between them.

5. A drier cabinet for use in a drier for drying fire-hoses or other similar hoses, said drier cabinet comprising:

an elongated horizontal receptacle divided into two parallel drying chambers extending in side by side relationship along the length of the receptacle and having individually closable longitudinal openings at their upper ends, hoses to be dried being insertable into said chambers through said openings and being placed side by side in extended positions to undergo drying in said chambers upon closure of the longitudinal openings;

a rotatable shaft extending between said receptacles;

a first cover and a second cover rigidly connected to said shaft; and means for rotating said shaft in a first direction so that said first cover is positioned to cover the longitudinal opening of one of said chambers and said second cover is spaced from the longitudinal opening of the other of said chambers and for rotating said shaft in a direction opposite said first direction so that said second cover is positioned to cover the longitudinal opening of the other of said chambers and said first cover is spaced from the longitudinal opening of the one of said chambers, said covers acting as counterweights for each other.

6. A drier cabinet according to claim 5 or 1, further comprising:

a grid-like supporting member in each of said drying chambers for supporting hoses placed in said drying chambers, said supporting member being spaced from the bottom of its associated chamber and extending along the entire length of the chamber.

7. A drier cabinet according to claim 5, characterized in that the upper surfaces of the two covers form an angle of about 120° between them.

8. A drier cabinet according to claim 6 or 5, further comprising an elongated box-like body positioned below and supporting said drying chambers.

* * * * *